United States Patent [19]

Ingold

[11] 4,167,670

[45] Sep. 11, 1979

[54] DENTAL X-RAY APPARATUS

[75] Inventor: Raymond W. Ingold, Muskego, Wis.

[73] Assignee: General Electric Company, Schenectady, N.Y.

[21] Appl. No.: 874,779

[22] Filed: Feb. 3, 1978

[51] Int. Cl.[2] ..... H05G 1/00

[52] U.S. Cl. ..... 250/402; 250/421; 250/409; 250/418

[58] Field of Search ..... 250/401, 402, 403, 408, 250/409, 421

[56] References Cited

U.S. PATENT DOCUMENTS

| | | | |
|---|---|---|---|
| 3,320,477 | 5/1967 | Boeker | 250/421 |
| 3,325,645 | 6/1967 | Splain | 250/416 |
| 3,521,067 | 7/1970 | Splain | 250/402 |
| 3,567,995 | 3/1971 | Lauritzen et al. | 250/409 |

*Primary Examiner*—Craig E. Church

*Assistant Examiner*—Thomas P. O'Hare

*Attorney, Agent, or Firm*—Ralph G. Hohenfeldt

[57] ABSTRACT

In dental x-ray apparatus a control is provided for driving the high voltage transformer in the tube head at a frequency far above power line frequency. The transformer is driven with an inverter. A precision d-c voltage regulator that operates in an "add-on" mode and thus only handles a portion of the output current controls the voltage supplied to the inverter. The d-c voltage regulator is supplied a voltage by a transformerless a-c/d-c converter whose output is proportional to the 60 Hz power line voltage that supplies it. The x-ray tube filament transformer is also driven at a frequency above power line frequency. Means are provided to cut off power to the x-ray tube if its current does not reach a certain value within a short time after an exposure is initiated. Means are provided for isolating high voltage power circuits from low voltage control circuits.

9 Claims, 3 Drawing Figures

DENTAL X-RAY APPARATUS

BACKGROUND OF THE INVENTION

This invention pertains to apparatus for making dental radiographs. The invention relates particularly to an electronically controlled system for delivering constant and precisely regulated d-c anode voltage and filament current to an x-ray tube to permit governing radiographic exposures exclusively by the user's choice of the exposure time interval.

Conventional dental x-ray apparatus comprises an oil-filled x-ray tube casing or tube head which is mounted on a pantograph arm or the like to permit the dentist to locate the x-ray tube adjacent a patient's head for making a radiograph. The tube head must be counterpoised to constrain it to remain where the user locates it. Consequently, it is desirable that the tube head be as small and lightweight as possible.

Traditional dental x-ray tube power supplies for controlling the x-ray exposure factors, that is, the anode voltage and current supplied to the x-ray tube and the exposure time, involve manually setting or regulating the voltage and stepping this voltage up at power line frequency to obtain the desired anode voltage with a transformer in the tube casing or head where it usually undergoes half-wave rectification before being applied between the cathode filament and the anode of the x-ray tube. The x-ray tube filament current which controls the temperature and electron emissivity of the filament and, hence, enables control over the x-ray exposure intensity, is also supplied through a transformer in the tube head. Since the transformers which supply the anode voltage and filament current operate at power line frequency, which is typically 50 or 60 Hz, their transformer cores must necessarily use a lot of core steel to minimize magnetic losses. This results in the x-ray tube head being heavy and bulky and causes some other problems which are well known.

The x-ray tube factor controls used in traditional dental x-ray apparatus have also been unduly bulky. One reason is that they operate at power line frequencies throughout. Another is that they employ large autotransformers to provide a variety of primary voltages to the high voltage anode transformer. Still another is that they are adapted to provide a variety of x-ray tube currents and x-ray exposure intervals. A basic problem that results from all this is that the electric power requirements become very high and the system becomes very susceptible to power line voltage fluctuations.

In addition, the electric power conversion and control systems used in prior dental x-ray apparatus exhibit low electrical efficiency. The input power to the apparatus is high compared with the useful output power delivered to the x-ray tube. The input and output power difference is wasted and only produces heat which is another problem the designer must cope with. The poor efficiency precludes dental x-ray power supply and control designs which can be operated from a low power supply circuit in a building.

Moreover, prior designs have resorted to bulky and expensive means to safeguard the user and patients against the hazard of electric shock which is always present in high voltage equipment.

SUMMARY OF THE INVENTION

The new dental x-ray apparatus power supply and control disclosed herein overcomes the problems mentioned above and other problems too.

The new apparatus provides for making all x-ray exposures with a single constant anode voltage and a single constant current being supplied to the x-ray tube. Only the x-ray exposure time is selectable by the user.

Typically, in a preferred embodiment of the invention, the fixed voltage applied to the x-ray tube is 70 kVp (kilovolts peak) and the x-ray tube current is fixed at 15 mA (milliamperes). For use in this country, the apparatus is supplied from a 115 volt, 60 Hz power line which does not have to supply more than 20 amperes.

One object of the invention is to minimize the weight and size of a dental x-ray tube casing or tube head as it is frequently called.

Another object is to provide a dental x-ray power supply and control which has high electric power utilization efficiency.

Another object is to provide means for obtaining unusually constant voltage and current on the x-ray tube during x-ray exposures regardless of variations in the power line voltage.

Yet another object is to reduce the size and weight of the transformers used in dental x-ray equipment for developing the high x-ray tube anode voltage and the requisite filament current by operating both transformers at frequencies far above the usual 50 or 60 Hz power line frequency.

Still another object is to provide an x-ray tube voltage regulator which uses electricity and space efficiently because, among other reasons, it does not have to regulate 100% of the electric power supplied to the high frequency and high voltage transformers in the tube head but only needs to regulate add-on voltage and power, that is, actually only a small increment of the power in excess of a fixed amount has to be regulated. Another object is to provide a dental x-ray power supply wherein the a-c supply line power is rectified in a first stage and, the output power thereof, is used to supply the low power electronic control circuits and, in regulated form, said power is used in the inverter which produces the high frequency power for the anode and cathode transformers. An adjunct of this object is to provide an add-on voltage regulator for the voltage that is supplied to the inverter wherein a feedback voltage for regulation is taken from its own d-c output rather than from the output of the high voltage and high frequency transformers in the tube head. Further incidents of this object are that the usual high voltage divider in the tube head is no longer required such that one wire to the tube head can be eliminated and loop compensation can be simplified.

Another significant object is to provide means for obtaining ground isolation between the low voltage limited energy circuits and the high power circuits to thereby enhance equipment and user safety.

Another object is to base regulation of the x-ray tube anode power supply on pulse width modulated control in a fashion which permits very precise and stable control and to base the regulation of the filament power supply on precise linear control.

Still another object is to provide for automatic shut down of the system if the x-ray tube current falls below a certain value to thereby protect the equipment against excessive peak kilovoltage which could develop and cause an arc in the x-ray tube head in the absence of tube current and to prevent unsatisfactory x-ray exposures from being made as would be the case if the x-ray tube current dropped while an exposure was in progress thus saving the patient from unnecessary exposure.

DESCRIPTION OF A PREFERRED EMBODIMENT

Figure 3:
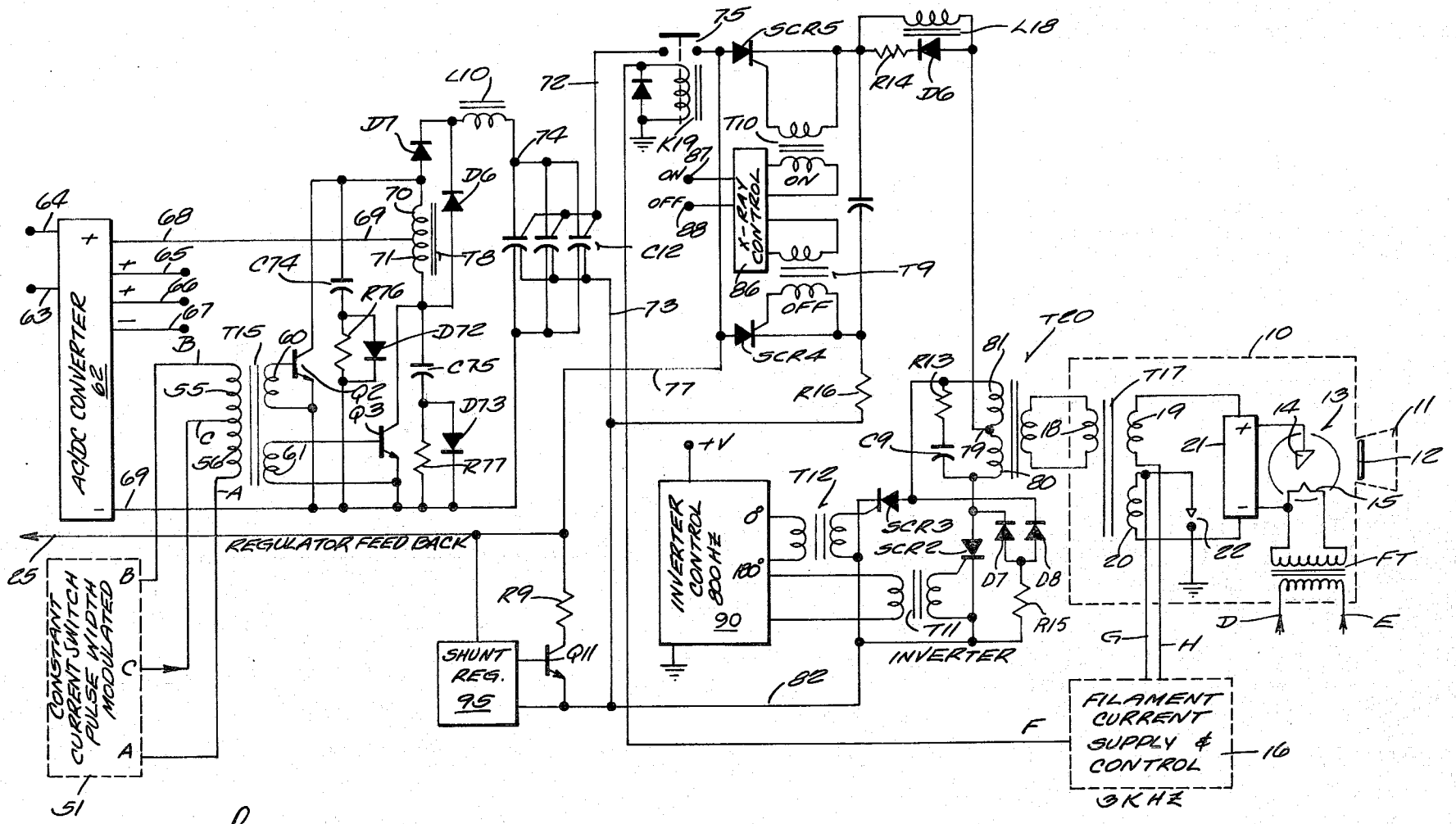

Refer first to the far right region of FIG. 3 where a dental x-ray tube head is symbolized by the dashed line rectangle 10. A cone through which the x-ray beam that is directed toward the patient emerges is shown schematically and is marked 11. Within cone 11 is a wafer 12, preferably of metallic samarium, for filtering out low energy x-radiation and letting primarily that radiation pass through which is in the wavelength band to which dental radiographic film is most sensitive.

The tube casing or head 10 may be a leakproof metal or plastic enclosure filled with insulating oil. Head 10 contains an x-ray tube 13 which has an anode or target 14 and a cathode or filament 15. In reality, the size and thermal capacity of this x-ray tube can be minimized and optimized because, in accordance with the invention, the tube is operated at constant anode voltage and filament current for x-ray exposures of all permissible durations. Two filament current supply wires lead out of tube head 10 in FIG. 3 and they are marked D and E. Wires D and E connect into correspondingly lettered wires in FIG. 3. This method of designating cross connections between the figures with letters will be followed, where practical, in the ensuing description. The filament current control and supply is also symbolized in FIG. 3 by the dashed line block or rectangle 16. The circuitry in block 16 will be discussed in detail later, primarily in reference to FIG. 2 where the circuits are actually located.

Tube head 10 also contains a high voltage step-up transformer T17 having a primary winding 18 and split secondary windings 19 and 20. The centers of the secondary windings run out on leads G and H and are part of a loop through which the x-ray tube electron beam current flows. This loop is for sensing the tube current for regulation purposes as will be evident later. Following the convention adopted above, G and H connect to correspondingly lettered points or lines in FIG. 2. The secondary windings 19 and 20 output lines of T17 are the inputs of a full-wave rectifier bridge, operating at tube anode voltage, symbolized by the block 21 in the tube head. The positive d-c output line from bridge 21 connects to the x-ray tube anode 14 and the negative line connects to the cathode 15 for applying high voltage between these tube elements during an x-ray exposure. A spark gap 22 is provided for protection against inordinate overvoltage if it should ever occur.

As mentioned earlier, in accordance with the invention, high voltage transformer T17 is driven with current at a frequency much higher than power line frequency. In an actual case, by way of example and not limitation, a square wave a-c at 800 Hz is used but a frequency of 500 Hz to 1,000 Hz or more, for instance, is in the realm of possibilities. An inverter circuit is shown in FIG. 3. It supplies the high frequency power to the primary of T17. A pulse width modulated voltage regulator for assuring that the inverter will be supplied with a very constant d-c voltage and that the high voltage transformer T17 will be supplied with a constant voltage is an important feature of the invention and will be described in detail later. The transformer FT for supplying x-ray tube filament current is also driven at high frequency with a control that will be explained. In a commercial embodiment, by way of illustration and not limitation, the filament current frequency is about 3,000 Hz but could conceivably range between 1000 and 4000 Hz.

Before leaving FIG. 3 temporarily, one may note that in the lower left part of this figure there is a line marked 25 which bears the legend "Regulator Feedback". Line 25 connects into line 25 at the left edge of FIG. 1 which is the starting place for explaining the x-ray tube add-on voltage regulator circuit which will be undertaken next. This feedback signal is from the output of the regulator which drives the inverter for developing the 800 Hz high frequency x-ray tube anode voltages.

Figure 1:
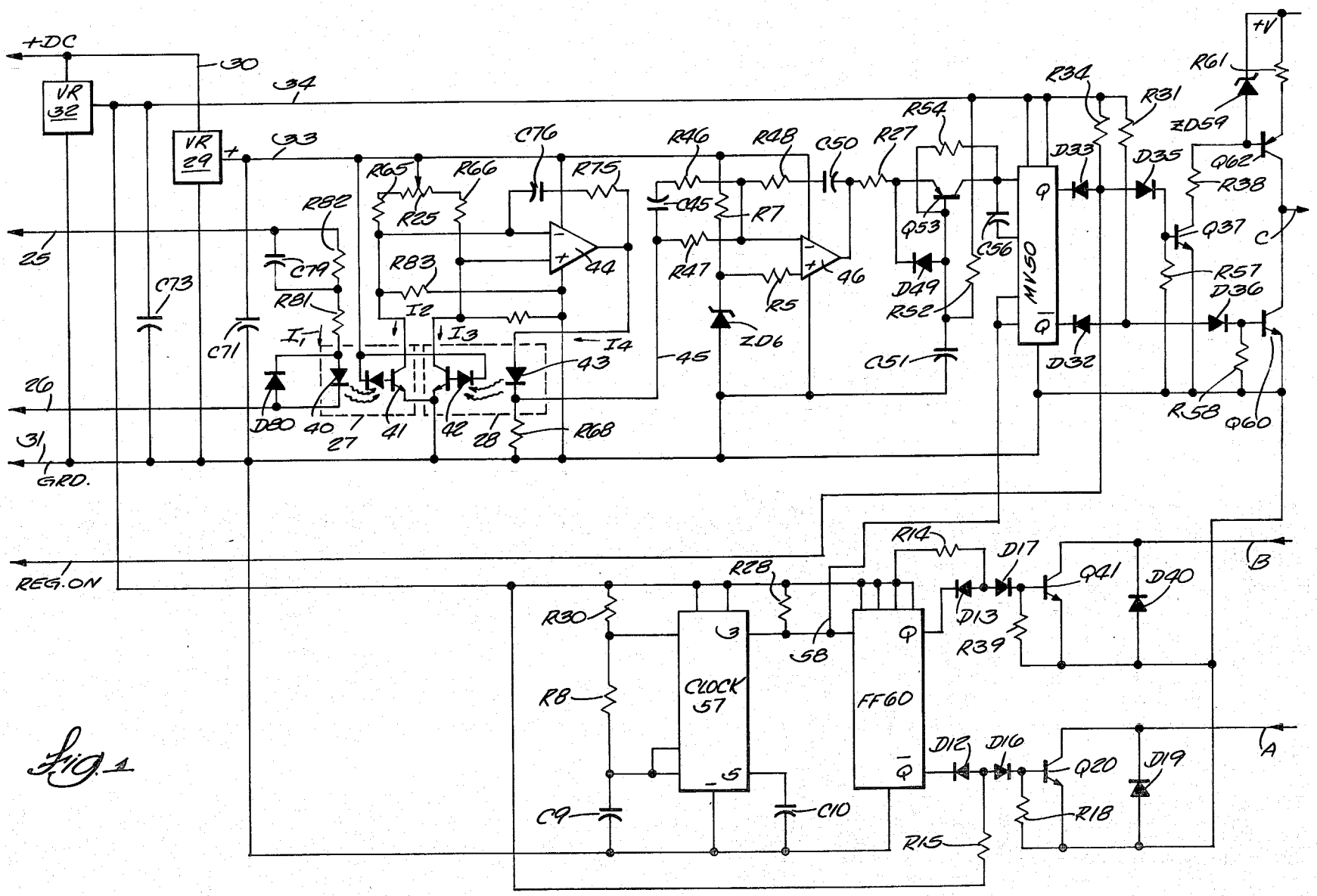
FIGS. 1, 2 and 3 are circuit diagrams which, when interconnected, constitute a circuit diagram for illustrating those features which are new in a dental x-ray apparatus power supply and control system.

Referring to FIG. 1, the d-c feedback voltage signal is applied between lines 25 and 26. In an actual embodiment, by way of example, this voltage may be as much as 140 volts at times. Isolation of this voltage and ground isolation from the low voltage circuits is obtained with optically coupled isolators 27 and 28 in FIG. 1 which are within the dashed line rectangles that are so marked. It will be evident that optical isolation is in a voltage sensing or sampling circuit which is used to control the regulator which controls the d-c voltage to the inverter that supplies the high voltage, high frequency anode transformer T17.

In FIG. 1, the sensing circuit is energized from an integrated circuit voltage regulator 29 whose input is connected between a d-c voltage supply line 30 and a low voltage ground line 31. The inputs to integrated circuit regulator 29 are taken from an a-c to d-c converter 62 in FIG. 3 which rectifies isolated line voltage directly as was mentioned briefly earlier. As an illustration, the voltage on line 30 is about 24 volts in an actual embodiment. There is another integrated circuit voltage regulator 32 which also has its inputs connected between d-c supply lines 30 and 31. The first part of the optically isolated circuitry is supplied with a well regulated voltage of 12 volts, for instance, on output line 33 from regulator 29. Another part of the circuitry is supplied from regulator 32 by way of its d-c output line 34. As an example, line 34 may have a regulated 5 volts on it.

Hereafter, for the sake of brevity, resistors will be designated by the letter R and a numeral, capacitors by C and a numeral, transformers by T and a numeral, diodes by D and a numeral, zener diodes by ZD and a numeral, inductances by L and a numeral, and controlled rectifiers by SCR and a numeral.

In FIG. 1, the feedback voltage applied between lines 25 and 26 is used for maintaining the d-c power supplied to the inverter constant. The feedback signal is used to develop a voltage across R68 in the output of optical isolator 28, which voltage is proportional to the high feedback voltage, such as 140 volts, across lines 25 and 26. The feedback voltage is applied across a series circuit comprised of R82, R81 and light emitting diode (LED) 40. The current through this circuit is $I_1$. A speed-up capacitor C79 parallels R82 and a reversely poled voltage limiting diode D80 parallels LED 40. In isolator 27, LED 40 is optically coupled with a phototransistor 41 whose current is $I_2$. The other isolator 28 has a phototransistor 42 whose current is $I_3$. It is optically coupled with an LED 43 whose current is $I_4$. A potentiometer R25 is used to set $I_3$ and $I_4$ equal initially and thereby correct for any unbalance which might exist in the phototransistor circuits. For instance, to obtain initial balance in an actual embodiment, R25 is adjusted until 6 volts appear across R68 when the feedback input voltage between lines 25 and 26 is 140 volts.

In general, the output current $I_4$ is forced to equal the input current $I_1$, through the nulling action of the voltage present on the input terminals of a differentially connected operational amplifier 44. R65 and R66 produce these voltage drops. Amplifier 44 has a feedback circuit consisting of C76 and R75.

The voltage across R68, which varies in proportion to any variations in the input voltage between lines 25 and 26, is applied by way of line 45 to the inverting input of an operational amplifier which is connected as a comparator 46. A stable reference voltage, for example, 6 volts, for the comparator is supplied through R7 to the noninverting input of the comparator from a divider consisting of R46 and ZD6. Loop compensation is achieved in this stage with C45, R47, feedback circuit C48 and C50 and output resistor R27.

The output error or sample signal from comparator 46 is fed through R27 to transistor Q53 which is connected in the common base mode and functions as a voltage controlled resistor. D49 and C51 provide a stable reference voltage for the transistor Q53. R52 and R54 properly bias the transistor Q53. converts the sample or error voltage signal fed to it to a proportional error current which is fed to C56, the latter being the timing capacitor for a monostable or one-shot multivibrator (MV) 50. The width of the pulses from MV 50, Q and $\overline{Q}$ outputs vary in accordance with the charge on C56. The main regulator that drives the 800 Hz inverter which feeds the primary winding 18 of the high voltage tube head transformer T17, which regulator and inverter will be described in due course, is in this example supplied with 140 volts d-c from the main line rectified power supply. This voltage is also given for the sake of illustrating the invention with concrete numbers. The transistor circuit element values are chosen so transistor Q53 will have a gain in the passband which will result in the pulses from MV50 varying in width by a percentage corresponding with the worse case percentage variation of the d-c voltage which supplies the inverter, this voltage being the one that is important is regulate.

The width varying pulses from the Q and $\overline{Q}$ outputs of MV50 feed a constant current switch. The purpose of the constant current switch is to provide a time varying pulse of constant current to the center tap of the inverter drive transformer T15 which is shown in FIG. 3. The constant current switch is symbolized in FIG. 3 by the dashed line rectangle marked 51. The elements actually comprising the switch are, nevertheless, depicted in FIG. 1 where the output terminals of this circuit are marked C, B and A and they actually connect to C, B and A, respectively, in FIG. 3.

Referring further to FIG. 1, the constant current source is achieved by connecting the cathode of a zener diode ZD59 between one end of R61 whose other end is connected to the emitter of a PNP transistor Q62 and the anode of ZD59 is connected to the base of Q62. A constant current is supplied by the collector of Q62 because a constant current is maintained through R61 which is in series with the emitter of Q62. By way of example, in this embodiment, the value of R61 is 27 ohms and the voltage across it is the zener voltage, 6 volts, minus the emitter to base voltage of Q62. Further in the interest of clarity that results from the use of illustrative numerical values, the given values would result in a collector current from Q62 fixed at 200 mA. This constant current source is compelled to switch by using a transistor Q37 to break the ground connection of the bias resistor R38 and zener diode ZD59. Transistor Q37 is driven by the Q output of monostable MV50.

Line C in FIG. 1 connects to the center tap C of regulator drive transformer T15 in FIG. 3. Lines B and A in FIG. 1 connect to B and A, respectively, in FIG. 3. These are the 0° and 180° drives. Constant current but duration variable current pulses are supplied out of C in FIG. 3 to the center tap C in the primary winding of T3 which has a split primary comprised of windings 55 and 56. As is evident, the return paths for alternate pulse half cycles is over lines A and B, respectively. As stated earlier, the width of the pulses is proportional to the voltage on MV50 timing capacitor C56 in FIG. 1 which is, in turn, proportional to be sampled error voltage coupled through R68 in optical isolator 28.

Further in FIG. 1, near the bottom, there is an integrated circuit timer 57, which may be a type NE555. It generates clock pulses at a frequency of 24 kHz, for instance, for triggering MV50 at this rate. The trigger pulses are supplied to MV50 from clock pulse generator 57 over line 58. The Q and $\overline{Q}$ outputs of MV50 thereby alternate high and low to produce the alternating time variable and sampled feedback voltage dependent or pulse width modulated current pulses. When the Q output MV50 is high, D33 becomes reverse biased with means that the junction point between the anodes of D33 and D35 goes high. This causes a pulse of current to flow through R34, D35 and R57 which turns on Q37 momentarily and it grounds the zener diode ZD59. When the Q output of MV50 goes low at the end of the pulse, it sinks current from D33 and $\overline{Q}$ goes high. Q37 turns off and ZD59 is isolated from ground, thus effecting the switching of the constant current source at the frequency of clock pulse generator 57. When $\overline{Q}$ of MV50 goes high, D32 becomes reversed biased and the junction point between the anodes of another pair of diodes D32 and D36 goes high. This results in bias current being supplied through R31, D36 and R58, thus turning on transistor Q60. The purpose of Q60 is to provide a low impedance path to ground line 31 so that the magnetic field of regulator drive transformer T15 collapses quickly to effect fast turn-off of the power transistors Q2 and Q3 which are driven by this transformer as can be seen in FIG. 3.

Clock pulse generator 57 is timed by the customary RC timing circuit for an astable NE555 timer comprised of R30, R8 and C9. In an actual embodiment, this timer has a 10% duty cycle. It has a small capacitor C10 which connects its pin 5 to supply voltage as is customary. Its output pin 3 is connected to a pull-up resistor R28. Pin 3 not only supplies the clock pulses over line 58 to trigger MV50 but, at the same time, it triggers a flip-flop (FF) 60 whose Q and $\overline{Q}$ outputs go alternately high and low for each alternate clock pulse thus effecting the switching of the output transistors Q20 and Q41 at ½ the frequency of the clock pulse generator 57. Steering or toggeling the current pulses to return from one leg and alternately from the other of the regulator drive transformer T15 is accomplished with FF60.

A pair of transistors Q20 and Q41 are alternately turned on and off by the changing Q and $\overline{Q}$ outputs of FF60. Thus, Q41 and Q20 toggle the 0° and 180° legs of T15. When the Q output of FF60 is high, it reverse biases D13 which causes the point between the anodes D13 and D17 to go high. Then, Q41 becomes forward biased through R14, D17 and R39 and Q41 turns on, thus providing a path for the coincident current pulse to the center tap C of T15 to return by way of line B through Q41. The next clock pulse to FF60 results in its Q output going low, thus turning off Q41, and its $\overline{Q}$ output to go high, thus turning on Q20 and providing a return path over line A and Q20 from the other leg of regulator drive transformer T15. Q20 and 41 can become alternately conductive at the proper time to receive the MV50 controlled current pulses because they are controlled by FF60 whose output is at ½ the clock frequency and MV50 is operating at the same clock frequency making them synchronized with one current pulse occurring for each of the Q20 and Q41 conduction times.

In an actual embodiment, the value of R61 in the constant current generator is so chosen that the constant current value is 200 mA, for example. Regulator drive transformer T15 has, for example, a 10:1 turns ratio to either of the secondary windings 60 and 61. Therefore, in this example, with a 200 mA pulse occurring in the primary, 2 A will appear in the secondary of T15. This allows the electronics to operate at relatively low currents while supplying substantial drive to power transistors Q2 and Q3. Note that T15 is one of the transformers that provides ground isolation between the low voltage limited energy circuits and high power circuits.

In FIG. 3, the two secondaries 60 and 61 of T15 are connected to the base and emitters, in opposite phase, to power transistors Q2 and Q3. Therefore, when a current pulse occurs at the primary center tap C and the 0° leg B is switched to ground by way of Q41, one power transistor base-emitter junction will receive a positive voltage and the other will receive negative voltage for the duration of the current pulse. When the current pulse is turned off and the center tap C is switched to ground, the base-emitter voltages in the secondary are both at 0 volts. They are held there until the 180° primary leg A is switched to ground and the next current pulse is applied. Then the opposite conditions occur in the secondary of T15. Q2 and Q3 are driven in the constant current mode to assure that they saturate properly in the on condition.

When the base drive to Q2 or Q3 is turned off, it is important that the bases be looking back into as low an impedance as possible so that the base stored charge is extracted as rapidly as possible. Therefore, transistors with very low storage times are required and switching techniques to maintain that time are employed. To provide as close to short circuit conditions as possible at turn-off, drive transformer T15 is wound with very low leakage inductance, the primary is shorted with a transistor, the secondary resistance is held very low and the secondary leads are kept as short as possible. The power supply for the voltage that is to be raised and regulated and supplied to the inverter which produces the 800 Hz voltage for the high voltage transformer T17 in the tube head, is derived from an a-c/d-c converter which is merely symbolized and marked 62 in FIG. 3. The input lines to the a-c/d-c converter are marked 63 and 64 which are supplied directly from the 115 volt, 60 Hz power system in the building. All power used in the system is d-c and is derived from converter 62. In this system, the converter supplies low voltage d-c, such as 35 volts, for use in control circuits by way of its output line 65. Another control circuit output line 66 may, for instance, be a 24 volt d-c output for low voltage control circuit purposes. Line 67 is the ground or return line for these power circuits and is isolated from line 69, the high power return.

Voltage from converter 62 which is to be raised to a higher voltage and then inverted for driving transformer T17 in the x-ray head is delivered from converter 62 over its output lines 68 and 69. Line 68 is positive and, in this example, can be assumed to be at approximately 100 volts d-c depending on the 60 Hz line conditions. Line 69 is negative and the ground return. This portion of supply 62 is transformerless.

Line 68 feeds to the center tap 69 of an autotransformer T8. If both transistors Q2 and Q3 are turned off, current will flow in through the center tap 69 of T8, out through both legs of 70 and 71 of T8, out through D6 and D7, and through inductor L10 to the output terminal 74. Several low inductance capacitors C12 are connected between output terminals 74 and negative line 69 for filtering purposes. The lines for supplying d-c to the load are marked 72 and 73.

Hence, when both transistors Q2 and Q3 are turned off, ignoring series losses, the output is connected to the input in this condition and approximately 100 volts is available on output line 72 assuming that the 800 Hz inverter is turned on. Actually, however, it is desired in this case to establish 140 volts d-c between lines 72 and 73 for driving the 800 Hz inverter. Typically, in this example, the on time range for transistors Q2 and Q3 is approximately 5 to 40 microseconds as governed by the modulated time varying current pulses from MV50. When Q2 and Q3 are both off, the voltage between lines 72 and 73 would be 40 volts d-c short of the desired output voltage and would have a variation in it proportional to 60 Hz line voltage changes. This 40 volts d-c at 10 amps in this example or 400 watts, is the portion that the power transistors have to handle since this is the difference between the 100 volts that is supplied and the 140 volts that is desired. Ths losses are approximately 25% of what they would be if the whole 400 watts needed to properly power the inverter were to be switched. The small variation is taken care of by controlling the pulse width of the add-on power.

The add-on power is, of course, the result of alternate switching of Q2 and Q3 which, through the autotransformer action in T 8, provides the make-up current and, hence, power.

The combination of inductor L10 and capacitor C12 is an averaging circuit. The current pulses which are caused to flow through opposite legs 70 and 71 of T8 by alternate switching of Q2 and Q3 actually have an amplitude of 100 volts on the output of the autotransformer. These pulses are added to the 100 volts that always exists at the output so as to produce 200 volts. Because of the short duty cycle of the pulses, however, and the averaging effect, 140 volts is finally produced on output lines 72 and 73. Of course, in the last analysis, the pulse width is controlled by the feedback voltage on regulator feedback line 25 in FIG. 3.

The voltage across capacitor C12 at point 74 goes to about 160 volts everytime transistors Q2 and Q3 are turned off and the 800 Hz inverter is not turned on. This is the case during the 0.8 second filament warmup time and is due to the fact that the power supply 62 is of the type that rises to peak line voltage when it is unloaded. It would be impractical to keep this supply loaded at all times and would waste much power. It is necessary to bring this voltage down to about 140 volts before the x-ray tube anode is energized to prevent overshoots in the high voltage at start up. This will now be explained.

Figure 2:
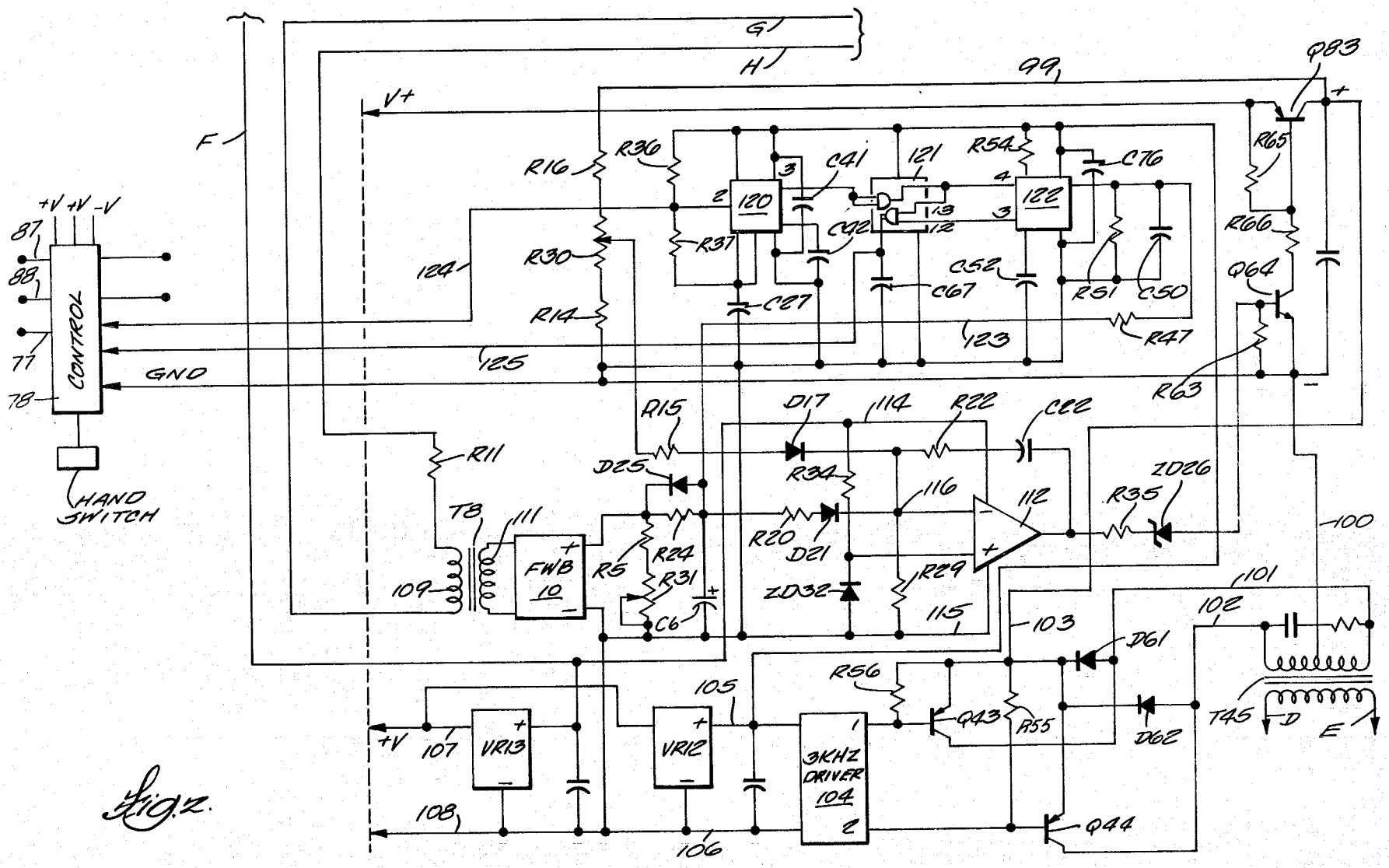

In FIG. 3, at the top, there is a safety relay K19 which is energized and closes its contact 75 in response to the user pressing a button on hand switch 76, see FIG. 2, to initiate an x-ray exposure. The filament starts to preheat as soon as the hand switch is pressed. The signal for energizing K19 is sent from the filament current supply 16 over line F in FIG. 2. As will be explained later, means are provided for permitting the filament 15 of the x-ray tube 13 to reach maximum emission temperature before the high voltage is applied between its filament and anode 14 to make an x-ray exposure. In an actual embodiment, the high voltage delay period is about 0.8 of a second. Relay K19 is energized over its input terminal with a signal over line F which is derived from the x-ray tube filament supply 16 which is shown symbolically in FIG. 3 and in detail in FIG. 2. One side of the operating coil for relay K19 returns to ground. When contact 75 of K19 is closed, the highly regulated d-c voltage supplied from lines 72 and 73 of the pulse width controlled regulator is supplied to a shunt regulator 95 by way of line 77. The shunt regulator drops the line voltage down to the desired 140 volts, in this example, immediately so this correct voltage will be applied to the 800 Hz inverter when the 0.8 sec. filament preheat period has expired. The inverter becomes energized and high voltage is applied to the x-ray tube in response to SCR5 in FIG. 3 being turned on as will be explained.

The x-ray on-off and exposure duration control is symbolized by the block marked 86 in FIG. 3. It has control signal input lines 87 and 88. Line 87 gets a pulse signal from within the main control 78 in FIG. 2 to initiate an x-ray exposure and line 88 gets a pulse signal at the time the exposure is to be terminated. These signals originate in control 78 of FIG. 2 where the lines are correspondingly marked 87 and 88. In an actual embodiment, a microprocessor, not shown, in control 78 governs the exposure interval which is selected by the user. Typically, about 12 exposure intervals of up to about 3 seconds may be selected in unequal steps with push buttons, not shown.

When the x-ray on pulse signal is received on line 87, SCR5 in FIG. 3 is turned on and the regulated voltage, which is exactly 140 volts in this example, regardless of any reasonable variations in power line voltage, is fed to the center tap of inverter transformer T20 for being chopped at 800 Hz. SCR5 is triggered on by applying a pulse signal to its gate from the secondary of a control transformer T10 and the SCR remains conductive during the exposure. SCR5 is turned off with a blocking SCR4 which is connected to oppose conduction of SCR5. SCR4 is triggered on for blocking by applying a pulse signal to its gate from the secondary of a control transformer T9. T9 produces a trigger pulse when an x-ray off pulse is received over line 88.

Part of the inverter drive which, in essence, chops the highly regulated 140 volts d-c delivered to the center tap 79 of 800 Hz transformer T20, is symbolized by the block marked 90 in FIG. 3. This block 90 is a conventional square-wave pulse generator, 800 Hz in this example, for driving T20 in the inverter. The primary winding of T20 is split into two legs 80 and 81. The end of leg 80, remote from the center tap 79, connects to the anode of a switching SCR2 and the end of leg 81 connects to the anode of a similar SCR3. The cathodes of SCRs 2 and 3 connect to the negative return line 82 which goes to the negative side of the regulated power supply by way of line 73. These SCRs are turned on and off alternatively at a rate that causes an 800 Hz square wave alternating current to be induced in the secondary winding of T20. The gate of SCR3 is triggered with pulses delivered through a control transformer T12 and SCR2 is triggered similarly with T11. When SCR3 turns on, conduction is from the center tap 79 of T20 through its leg 81. When SCR 2 is turned on, SCR 3 becomes reverse biased and blocked, and conduction is from the center tap 79 through leg 80 of T20. The voltage for blocking the commutating SCRs 2 and 3 alternately is obtained from commutating capacitor C9 which is in series with a low valued R13. Blocking or turn off of the SCRs is done conventionally. When SCR3 is conducting, the lower plate of C9 charges positively through leg 80 and to negative line through SCR3. When SCR2 is triggered on, it permits the positive voltage on C9 to reverse bias the cathode to anode path of SCR3. Conversely, when SCR2 is conducting, the upper plate of C9 charges positively to leg 81 of T20 so when SCR3 is turned on in sequence, this positive voltage is applied through SCR3 to reverse bias SCR2 and turn it off. Diodes D7 and D8 provide a conductive path for the reactive current of T20 during switching of the SCRs.

When the highly regulated alternating voltage is fed through the primary windings of T20, a stepped up alternating voltage of similar waveform, that is, 800 Hz, is produced in the secondary of T20. In an actual embodiment, the secondary voltage is 200 volts, for example. This voltage is fed by way of a suitable cable to the primary of transformer T17 in x-ray tube head 10 which steps the voltage up to about 70 kilovolts that, in this case, is the desired single and constant voltage for all x-ray exposures.

As stated earlier, the secondary current of T17 is rectified in a high voltage full-wave rectifier bridge 21 in the tube head 10 and is applied between the x-ray tube anode 14 and cathode 15 at 70 kVp which is held absolutely constant during an x-ray exposure of any selected duration.

In the last stage of the precision regulator in FIG. 3, there are the group of low inductance filter capacitors C12. When the system is first turned on, the voltage on C12 could jump to 160 volts, for instance, because there is no load on the capacitors, and then drop to the regulated 140 volts after the shunt regulator takes effect following closure of the K19 x-ray enabling relay contacts 75. When the regulator system is triggered on in this condition, the output voltage on C12 would be pulled down to about 140 volts. This could cause an overshoot of thousands of volts on the x-ray tube and nonuniform x-ray output from the tube during an exposure interval and cause unnecessary stress on the electrical insulation. The shunt regulator reduces this C12 precharge to a lower value and thus, enables smooth x-ray tube turn on.

The shunt regulator transistor Q11 in FIG. 3 is in series with a limiting resistor R9 and this series circuit is connected between the negative side of C12 and the positive side beyond the contact 75 of relay K19. Hence, the shunt regulator is not energized until the x-ray tube is enabled by closure of contact 75 just prior to an x-ray exposure start. The shunt regulator may be triggered on by applying a signal to it to control input 96 at this time from control module 78 in FIG. 2. The power dissipation is shunt regulator 95 would contribute toward defeating the low power consumption objective for the system if it were on all the time. Since there is a 0.8 second warm-up time for the x-ray tube filament before every exposure is initiated, the shunt regulator can be turned on by a pulse on its trigger signal input 96 at the beginning of this time and it will stop consuming any significant power in the very short time that it takes for the voltage across the series circuit consisting of R9 and Q11 to drop to the set value of 140 volts since a shunt regulator is inherently self-limiting. Thus, no current will flow through Q11 during an exposure interval. At the instant SCR5 is triggered so the inverter and x-ray tube anode have voltage applied, the precision regulator takes over because of regulator feedback over line 29 in FIG. 3.

The high voltage inverter circuit has been described as operating at 800 Hz for the sake of illustration but it will be understood that this frequency could be anywhere in the range of 500 Hz to 1,200 Hz depending on other circuit parameters which the designer may have selected.

The x-ray tube filament current control and safety shutdown system will be described next primarily in reference to FIG. 2. The filament transformer is in the tube head 10 and is marked FT in FIG. 3. The primary winding of this transformer is supplied with a 120 volt peak-to-peak square-wave alternating current at a frequency of 3 kHz. Driving the x-ray tube filament 15 at this high frequency permits reducing the size of the filament transformer FT significanty as compared with the size it would have if it were driven at power line frequency as is conventional. The input leads to the filament transformer FT primary winding are marked D and E in FIG. 3 and they run back to the secondary terminals of an output transformer T45 in FIG. 2 where the details of the filament current control are shown.

In this embodiment, transformer T45 is driven at 3 kHz which is produced by chopping a well-regulated d-c supply voltage. The primary of T45 is split into two windings. Its center tap is supplied with d-c over a line 100 which connects to the negative side of a series regulator which will be described later. Lines 101 and 102 lead from the outsides of the legs in the primary of T45. These lines are in series with switching transistors Q43 and Q44, respectively. A line 103 runs to the positive side of the series regulator. Q43 and Q44 are turned on and off alternately at a 3 kHz rate by a 3 kHz clock and driver symbolized by the block 104. When pin 1 of driver 104 goes low, bias current flows through R56 and Q43 turns on. This causes current flow from line 103 through Q43, line 101, one leg of T45 to the center tap and then to negative side of the line by way of line 100. When pin 1 goes high and pin 2 goes low, bias current flows from line 103 through biasing resistor R55 thus turning one Q44 to effect current flow from line 103 through Q44, line 102, the other leg of T45, to the center tap and to the negative side of the supply by way of line 100. This action results in the 3 kHz voltage being developed on the secondary of T45 across its output lines D and E. Diodes D61 and D62 provide a path for reactive current from T45 as the transistors are switched alternately.

Driver 104 is supplied with power from a voltage regulator VR12 which has output lines 105 and 106 connected to the driver. 106 is a common ground return. There is another regulator VR13 which supplies low control voltage to another part of the circuit as will be explained. Lines 107 and 108 are the input lines to these regulators. Line 107 is positive and may, for example, be a 24 volt line. Voltage is applied between lines 107 and 108 concurrently with the beginning of a filament warm-up time. When the operator presses the hand switch 76 to initiate an exposure, the associated control 78 effectuates application of the voltage to lines 107 and 108. Thus, filament transformer T45 is only energized for the 0.8 second warm-up time plus the exposure interval time. This minimizes the electrical losses in the system and avoids having to dissipate an excessive amount of heat from the filament.

When the x-ray tube conducts, a corresponding current, of course, flows through the secondary windings 19 and 20 of the high voltage transformer T17 in the tube head. The center tap of the secondary is split to provide two lines G and H which run to the top of FIG. 2. These two lines are a feedback loop conducting a-c proportional to the 15 milliampere d-c x-ray tube current. This a-c current is sensed and used to control the series regulator for the constant voltage that is chopped and applied to the primary of the 3 kHz transformer T45.

In FIG. 2, the tube current is conducted through R11 and the primary winding 109 of a transformer T8. A full-wave rectifying bridge FWB110 is supplied from the secondary 111 of T8. The output voltage from bridge 110 is sensed and used to control the series regulator transistor Q83 in the upper right corner of FIG. 2. Control of regulator transistor Q83 is obtained with an error voltage that is supplied from an operational amplifier 112 which is connected as a comparator. The reference voltage for the comparator, supplied to its inverting terminal, is obtained from ZD32 which is in series with R34. The reference voltage circuit is connected across line 114, which is supplied from VR13, and negative line 115. The reference voltage is compared with whatever voltage is developed at a junction point 116 which is connected to the non-inverting input of comparator 112. Comparator 112 has a feedback circuit comprised of C22 and R22. A voltage corresponding with the instantaneous x-ray tube current is developed across R29 or, in other words, between junction point 116 and negative line 115. The junction point 116 may receive two sample voltages. One voltage is applied through R24, R20 and D21. This d-c voltage corresponds with the a-c voltage on the secondary of the high voltage transformer T17 in the tube head 10. This voltage may be trimmed by adjusting a variable resistor R31 in series with R5. This voltage appears on the summing point 116 under dynamic conditions; that is, during the time an x-ray exposure is in progress. Another voltage at point 116 is representative of voltage on the collector of the series regulator transistor Q83. This voltage is applied by way of line 99 to a voltage divider comprised of a variable resistor R30 in series with R14 and R16, which series circuit is thus connected between the positive and negative lines of the supply for T45. The wiper of R30 in the divider circuit comprised of R16 and R14 is connected through R15 and D17 to point 116. This results in a sample voltage representative of the series regulator voltage during idling; that is, when no current is flowing through the x-ray tube and this sample voltage is compared with the reference voltage from ZD32 at this time and governs the output voltage of the comparator 112 under this condition. The output voltage of comparator 112 is applied by way of R35 and ZD26 to the biasing resistor R63 for voltage sampling transistor Q64 of the series regulator which transistor acts as a variable resistor. Variations in the collector voltage of Q64 vary the conductivity of series regulator transistor Q83 in the usual way by varying its base bias by way of R66 and R65. This type of voltage control is effective only during filament warm-up.

As soon as the circuitry is energized in preparation for taking an exposure, line F goes high to energize relay K19 in FIG. 3 though the voltage applied to the x-ray tube will be stable by the time the filament warm-up period expires. When the x-ray tube starts to conduct, the sample voltage from FWB10 becomes available to junction point 116. When the voltage through D21 exceeds the cathode voltage on D17, this excess voltage becomes the sensed voltage for real time or dynamic control. When D21 conducts, D17 is reverse biased during an exposure.

The circuitry for effecting shutdown of the x-ray tube if the tube current is not between permissible low and high limits during an exposure will now be described. This circuit prevents possible damage to the equipment, since an absence of tube current can cause the peak kilovoltage to be excessive and create a voltage arc in the tube head. Moreover, tube current below a certain minimum can cause a dental radiograph to be unsatisfactory.

In this example, if the tube current does not achieve a level above 7 mA or about 50% of full value within a period of 35 ms or if the tube current falls below 7 mA at any time after start of x-ray generation, the system shuts down.

In the upper part of FIG. 2, there are three integrated circuits involved in performing this function in this example. They are a type NE555 timer 120, a dual inverter 121 and another NE555 timer 122. Timer 120 serves as a time delay circuit and timer 122 serves as a voltage comparator. A d-c voltage proportional to x-ray tube current is applied by way of line 123, through R47 to pin 2 of timer 122. At the left, is a line 124 which runs to the microprocessor control 78. The microprocessor removes a ground from line 124 and pin 2 of timer 120 at the start of x-ray generation.

In 35 msec after pin 2 of timer 120 goes low, its output pin 3 goes low. This low level signal is then inverted in inverter 121 and the resulting logic high signal on its pin 3 is used to enable pin 4 of timer 122 and to also enable a pin 13 of a buffer gate in inverter 121. Output pin 3 of timer 122 then achieves a state depending on the voltage level at pin 2 of timer 122, which as stated earlier, is a d-c voltage directly proportional to tube current. Typically, for this embodiment, if input pin 2 of timer 122 is greater than 1.9 volts d-c, output pin 3 will be low. If input pin 2 is less than 1.45 volts d-c, output pin 3 of timer 122 will be high. The pin 3 output of timer 122 is then inverted through inverter 121 and applied to the on-off latch of the system by way of line 125. The latch is not shown but it is in control 78. A logic low on line 125 will then shutdown the system and terminate x-ray generation if there was any to begin with. Values of the circuit elements associated with timer 120 for obtaining a 35 msec delay are as follows. R36 is 510 ohms, R37 is 6.8 K, C41 is 0.01 microfarads, and C27 is 4.7 microfarads.

For timer 122, C76 is 0.01 microfarads, C52 is 0.01 microfarads, C50 is 0.1 microfarads, R51 is 5.1 K and R54 is 1 K. C67, associated with inverter 121 is 0.01 microfarad. The voltage applied to these integrated circuits is 5 volts.

The foregoing arrangement and values are given simply for illustration. The shutdown circuit can be variously arranged. For instance, the number of circuit components could be reduced by replacing the NE555 timers 120 and 122 with a single package type 556 which contains two 555 timers. The comparator timer 122 which compares voltage sample that is proportional to tube current with an internal reference, could be more tightly controlled by using an external voltage reference fed in on its pin 5. The comparison function of timer 122 could be performed even more accurately by utilizing a precision voltage reference, not shown, and some other standard voltage comparator circuit.

I claim:

1. Dental x-ray apparatus comprising a housing, an x-ray tube having an anode and a cathode filament disposed in said housing for projecting x-radiation therefrom, a step-up transformer in said housing having a primary winding and at least a pair of secondary windings and a loop circuit connecting said secondary windings in series, rectifier means in said housing, having input means coupled with said secondary windings and d-c output terminals to which said anode and cathode of said tube are connected, respectively, a low voltage filament transformer in said housing having its secondary winding connected for energizing said filament and having a primary winding, and an improved power supply for said x-ray tube including:

a. a-c to d-c converter means having input means for coupling to an a-c power line and having d-c output terminals, said converter means being operative to provide to its output terminals a first d-c voltage which is constant and below a predetermined desired voltage, b. d-c storage means having input and output means, c. means for adding on an increment of d-c voltage to said first d-c voltage from said converter output means and for supplying the sum of said increment and said first d-c voltages to said d-c storage means, d. inverter means having input and output means, said input means being supplied from said d-c storage means output terminals, said output means of said inverter means being coupled to said primary winding of the step-up transformer, said inverter means being operative to convert d-c power to a-c power, and e. means for sensing the voltage on said storage means, and means responding to the sensed voltage by controlling said means for adding on said voltage increment to add on an increment that results in said predetermined voltage being developed on said storage means.

2. The apparatus as in claim 1 wherein said means for adding said increment of voltage comprises:

a. a constant current source, b. means for switching said constant current from said source to produce current pulses of constant magnitude, c. means for controlling said means for switching to modulate the width of said current pulses in correspondence with the total d-c voltage of said storage means, d. an autotransformer having an input terminal for being connected to a one polarity output terminal of said a-c to d-c converter means and having first and second output terminals, e. rectifier means connecting said first and second output terminals of said autotransformer, respectively, to said d-c storage means, and f. switch means interposed between said autotransformer output terminals, respectively, and the opposite polarity output terminal of said converter means, said switch means being controlled to conduct alternately for durations corresponding with the widths of said width modulated pulses to thereby add said increment of voltage to said first voltage.

3. The apparatus as in claim 2 including:

a. a transformer having a primary winding composed of two winding legs and a tap intermediate said legs and having two secondary windings, and b. means for switching alternate ones of said width modulated pulses to be conducted through one and the other of said primary winding legs, said switch means which are interposed between said respective autotransformer terminals and said opposite polarity output terminal comprising semiconductor switches for being turned on alternately in response to signals from said secondary windings which are induced from said primary winding legs.

4. The apparatus as in claim 2 wherein said means for controlling said means for switching to modulate the widths of said pulses comprises:

a. voltage controlled switching means having output means switchable between alternate states and coupled with said means for switching said constant current source and including means for developing a control voltage that is effective to control the duration of said states, b. clock means for triggering said voltage controlled switching means to change states at a constant repetition rate, c. means for producing a voltage corresponding with the voltage on said d-c storage means and comparator means responsive to comparing said voltage with a reference voltage by producing an error current signal, and d. variable resistance means for coupling said current signal to said voltage developing means and controlled by said error signal to determine said control voltage whereby to control the duration of said states and the width of said current pulses.

5. The apparatus as in claim 4 wherein said variable resistance means is a transistor means connected for having its conductivity varied in correspondence with variations in said error signal.

6. The apparatus as in claim 4 wherein said means for producing said voltage that corresponds with the voltage on said d-c storage means includes:

a. optical coupling means having input and output means, said input means being coupled to said d-c storage means, and b. means coupled with said output means of said optical coupling means by producing a d-c signal which is lower than an proportional to the voltage applied to said input means, said signal being the voltage which is compared with said reference voltage by said comparator means.

7. Dental x-ray apparatus comprising a housing, an x-ray tube having an anode and a cathode filament disposed in said housing for projecting x-radiation therefrom, a step-up transformer in said housing having a primary winding and at least a pair of secondary windings and a loop circuit connecting said secondary windings in series, rectifier means in said housing, having input means coupled with said secondary windings and d-c output terminals to which said anode and cathode of said tube are connected, respectively, a low voltage filament transformer in said housing having its secondary winding connected for energizing said filament and having a primary winding, and an improved control circuit comprising:

a. a-c to d-c converter means having input means for coupling to an a-c power line and having first and second output terminals between which said converter is operative to provide a nominally constant d-c voltage, b. d-c storage means having input and output means, c. means for regulating the voltage level on said d-c storage means at a higher level than a predetermined level which is desired when said x-ray tube is to be energized for projecting radiation, d. inverter means having input and output means, said input means being supplied from said d-c storage means output, said output means being coupled to said primary winding of said stepup transformer, said inverter means being operative to convert d-c power to a-c power, and said secondary winding supplying said a-c power to said rectifier means, e. control means including a relay means for connecting said d-c storage means to said input means of the inverter means, f. a shunt voltage regulator connected in parallel with the input means of said inverter means and connected for being deenergized before said relay means connects said d-c storage means to said inverter means input means, g. means for preheating said cathode filament upon closing of said relay and for shunting a portion of the voltage on said d-c storage means through said shunt regulator during the time said preheating takes place so as to provide the required d-c level on the input of said inverter means upon completion of preheating.

8. Dental x-ray apparatus comprising a housing, an x-ray tube having an anode and a cathode filament disposed in said housing for projecting x-radiation therefrom, a stepup transformer in said housing having a primary winding and at least a pair of secondary windings and a feedback loop circuit connecting said secondary windings in series, rectifier means in said housing, having input means coupled with said secondary windings and d-c output terminals to which said anode and cathode of said tube are connected, respectively, a low voltage filament transformer in said housing having its secondary winding connected for energizing said filament and having a primary winding, and an improved filament control circuit for said x-ray tube including:

an output transformer having a primary winding and a secondary winding with said secondary winding coupled to said primary winding of said low voltage filament transformer, a clock and driver circuit operating in the range of 1 to 3 kHz and having an output connected to said primary winding of said output transformer, a control circuit including an operator controlled switch which when activated supplies voltage to said clock and driver circuit, an isolation transformer having a primary winding connected in said feedback loop in said secondary windings of said stepup transformer for such isolation transformer primary winding to conduct a-c current which corresponds with the d-c current that flows between said anode and cathode of the x-ray tube, full wave rectifier connected to the secondary winding of said isolation transformer, comparator means connected to said rectifier for comparing the instantaneous x-ray tube filament current and a d-c voltage signal representing the a-c voltage level on said secondary winding of said stepup transformer, and a series regulator circuit having an input line connected to said comparator means and an output connected to said primary winding of said output transformer, whereby during x-ray exposures the actual filament current is sensed and accurately controlled.

9. The filament control circuit of claim 8, wherein said comparator means compares a signal roughly approximating tube filament current when x-ray exposure is off.

* * * * *